US008109076B2

(12) United States Patent
Colet et al.

(10) Patent No.: US 8,109,076 B2
(45) Date of Patent: Feb. 7, 2012

(54) METHOD AND DEVICE FOR PURGING AN INJECTOR IN A FUEL INJECTOR SYSTEM OF USE IN THE REGENERATION OF A PARTICULATE FILTER

(75) Inventors: Francois Colet, Bois-Colombes (FR); Richard Roth, Nanterre (FR); Gustavo Loureiro Nieto, Rueil Malmaison (FR); Nicolas Palanque, Vincennes (FR); Laurent Le Garff, Viroflay (FR)

(73) Assignee: Renault S.A.S., Boulogne Billancourt (FR)

( * ) Notice: Subject to any disclaimer, the term of this patent is extended or adjusted under 35 U.S.C. 154(b) by 436 days.

(21) Appl. No.: 12/482,242

(22) Filed: Jun. 10, 2009
(Under 37 CFR 1.47)

(65) Prior Publication Data

US 2010/0139252 A1 Jun. 10, 2010

Related U.S. Application Data

(63) Continuation of application No. 12/279,676, filed as application No. PCT/FR2007/050811 on Feb. 16, 2007, now abandoned.

(30) Foreign Application Priority Data

Feb. 17, 2006 (FR) ..... 0601411

(51) Int. Cl.
*F01N 3/00* (2006.01)

(52) U.S. Cl. ..... 60/277; 60/274; 60/286; 60/295; 60/311; 123/1 A; 123/406.3; 123/406.31

(58) Field of Classification Search ..... 60/274, 60/276, 277, 286, 295, 297, 311; 123/1 A, 123/406.3, 406.31, 406.32
See application file for complete search history.

(56) References Cited

U.S. PATENT DOCUMENTS

| | | | | |
|---|---|---|---|---|
| 5,193,340 | A | 3/1993 | Kamihara | |
| 6,983,589 | B2 * | 1/2006 | Lewis et al. | 60/277 |
| 6,997,172 | B2 * | 2/2006 | Oshimi et al. | 123/685 |
| 6,998,361 | B2 * | 2/2006 | Lewis | 501/36 |
| 7,367,223 | B2 * | 5/2008 | Kettl et al. | 73/53.05 |
| 7,469,531 | B2 * | 12/2008 | Viola | 60/286 |
| 7,552,585 | B2 * | 6/2009 | Rigaudeau et al. | 60/295 |
| 7,908,843 | B2 * | 3/2011 | Doumeki et al. | 60/286 |
| 2004/0226288 | A1 | 11/2004 | Okugawa et al. | |
| 2005/0103099 | A1 | 5/2005 | Van Nieuwstadt et al. | |
| 2005/0210869 | A1 | 9/2005 | Rudelt et al. | |

* cited by examiner

*Primary Examiner* — Binh Q Tran
(74) *Attorney, Agent, or Firm* — Oblon, Spivak, McClelland, Maier & Neustadt, L.L.P.

(57) ABSTRACT

A method and a device for purging an injector in a fuel injector system of use in regeneration of a particle filter. The aging of fuel is determined and compared with a fuel aging threshold value, and a purge request is activated if the threshold value is exceeded. On activating the purge request the satisfaction of the conditions of purge activation are verified and, if satisfied, the purge is activated. The purge is continued while the conditions are satisfied until the quantity of fuel purged reaches a quantity of fuel to be purged.

5 Claims, 3 Drawing Sheets

METHOD AND DEVICE FOR PURGING AN INJECTOR IN A FUEL INJECTOR SYSTEM OF USE IN THE REGENERATION OF A PARTICULATE FILTER

CROSS REFERENCE TO RELATED APPLICATION

This application is a Continuation of and claims the benefit of priority under 35 U.S.C. §120 from U.S. Ser. No. 12/279,676 filed Aug. 15, 2008 which was the national stage of and claims the benefit of priority under 35 U.S.C. §119 from International Application No. PCT/FR07/50811 filed Feb. 16, 2007 which claimed the benefit of priority from French Patent Application No. 0601411, filed on Feb. 17, 2006, the entire contents of each of which are incorporated herein by reference.

TECHNICAL FIELD

The invention relates to a method and a device for purging an injector in a fuel injection system used in the generation of a particulate filter.

Since European emission control standards are becoming more and more stringent, it is important for automobile manufacturers to reduce the polluting emissions of their engines. Currently, the restrictions cover not only the oxides of nitrogen ($NO_x$), but also the particulates emitted, called black smoke, which can be the cause of certain respiratory ailments and certain cancers, according to the latest medical studies. Thus, in order to reduce the emissions of this black smoke by trapping the particulates, various filters called particulate filters (FAP), which can be incorporated in the exhaust pipe of the vehicle, are being studied and developed by the manufacturers.

However, one of the technical problems to be solved is not only the capture of the particulates but also their elimination in order to prevent the clogging of the filter. Various methods of regeneration can be used, such as for example what is known as a natural regeneration during the phases when the engine is operating at high engine speed and high load. Other methods consist in starting the regeneration of the filter by carrying out retarded injections or post-injections during the power stroke of the engine. However, the use of post-injection, in particular at low load, causes a dilution of the engine oil by the unburned diesel fuel passing between the segments of the piston and the walls of the cylinder. This can affect the correct operation of the engine very adversely.

In order to overcome this disadvantage, the use of another method is known, consisting in injecting some diesel fuel directly into the exhaust gases using an injector installed in the exhaust pipe. The documents FR 2,853,006 and US 2004/0226 288 describe systems of this type.

However, these systems have several disadvantages:

- the aging of the diesel fuel in the injection circuit can lead to the formation of particulates or residues which block the injector;
- the evaporation of the diesel fuel at the injector outlet can cause its clogging if insoluble substances are present in it;
- the thermal aging of the diesel fuel can adversely affect its self-ignition capacity measured by its cetane number and consequently the regeneration of the particulate filter;
- an accumulation of deposits due to the exhaust gas can occur under the tip of the injector during periods of non-use.

To be precise, the subject of the present invention is a method for purging an injector in a fuel injection system used for the regeneration of a particulate filter, which overcomes these disadvantages.

These objectives are achieved due to the fact that:

- the aging of the fuel is determined, it is compared with a fuel aging threshold value and a purge request is activated if this threshold value is exceeded;
- when the purge request is activated, the meeting of conditions for activating the purge is checked and, if they are met, the purge is activated;
- the purge is continued as long as these conditions are met, until the quantity of fuel purged reaches a quantity of fuel to be purged.

Preferably, a fuel aging counter is determined at step N by multiplying an aging factor based on aging variables by an aging time and adding the result obtained to the aging counter at step N−1.

Advantageously, the aging variables are the temperature of the water and the temperature of the exhaust gases at the inlet of a catalytic converter disposed upstream of the particulate filter.

Preferably, the conditions for activating the purge are, in addition to the fact that the purge request is activated, the fact that the regeneration mode of the particulate filter is not active, the fact that the temperature of the gases at the inlet of the particulate filter is higher than a threshold value (T1) and the fact that the amount of air in the exhaust gases is lower than a threshold amount (Q1).

If the purge is interrupted by a regeneration of the particulate filter (10), the quantity of fuel (Qrégé) used for the regeneration is considered as contributing to the purge.

Moreover, the invention relates to an injection system used for the regeneration of a particulate filter comprising:

- an engine;
- an exhaust pipe on which are disposed in this order, starting from the engine, a first oxidizing catalytic converter, a second oxidizing catalytic converter and a particulate filter; and
- an injector used for the regeneration of the particulate filter, characterized in that the injector used for the regeneration of the particulate filter is disposed between the first oxidizing catalytic converter and the second oxidizing catalytic converter.

Other features and advantages of the invention will yet emerge on reading the description which follows of embodiments given as examples, with reference to the attached figures.

Figure 1:
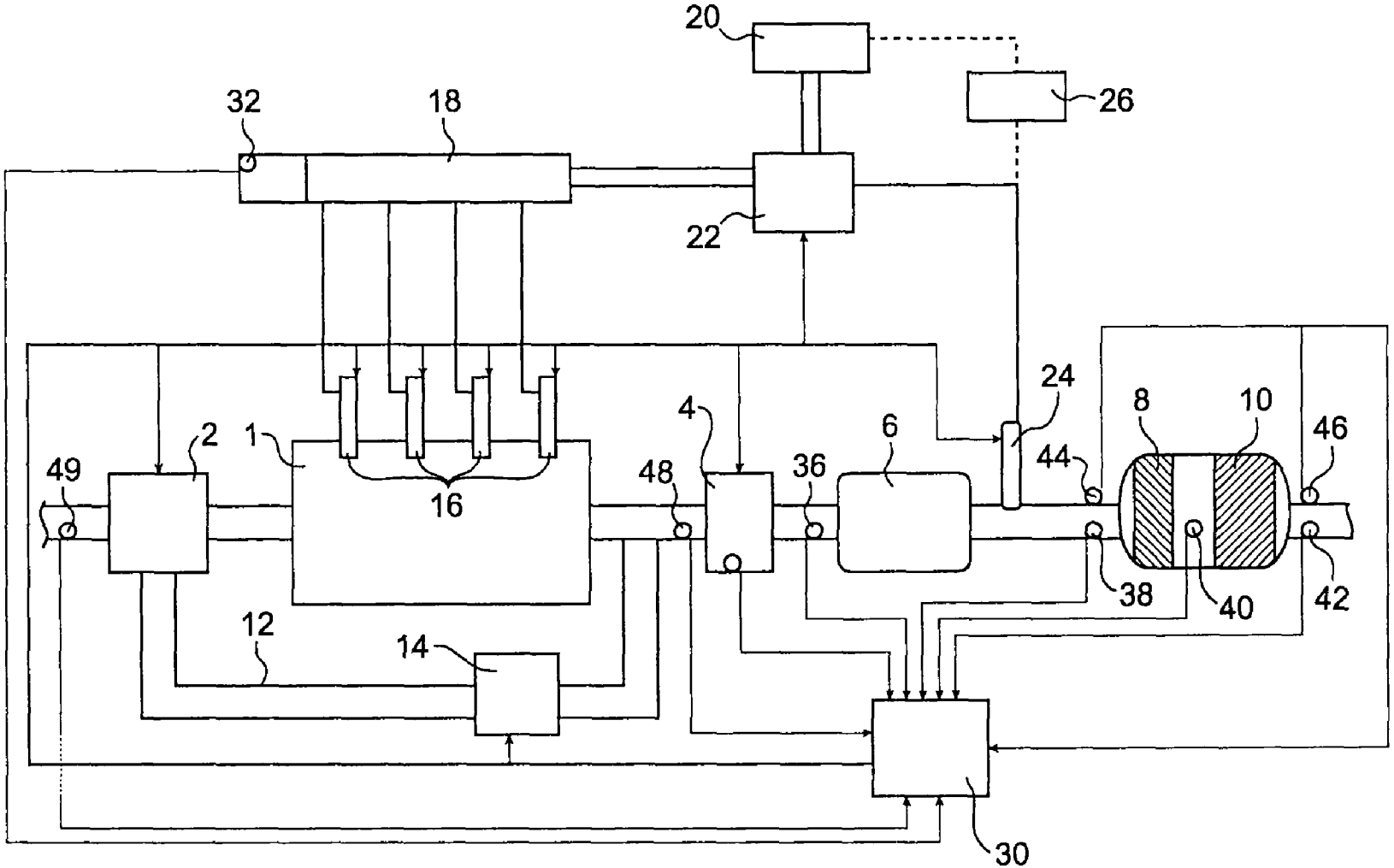
FIG. 1 is a general schematic drawing of an injection system used for the regeneration of a particulate filter in which the inventive method is applied.

In FIG. 1, the reference number 1 identifies a diesel engine illustrated schematically. To the left in the figure the diesel engine 1 is fed with air by air intake means 2 illustrated schematically, for example air intake manifolds. To the right in the figure the diesel engine 1 includes an exhaust pipe in which are mounted respectively and successively a turbocharger 4, and a first oxidizing catalytic converter 6, a second oxidizing catalytic converter 8 and a particulate filter 10. After the particulate filter the exhaust pipe is open to the atmosphere.

An exhaust gas recirculation bypass 12 is mounted between the exhaust pipe and the air intake means 2. Means 14, for example a valve, recycle the engine exhaust gases to the engine intake.

The combustion chambers of the diesel engine are fed with fuel by injectors 16 equal in number to the number of cylinders of the engine. These injectors are fed from a common injection rail 18. The rail 18 is fed with fuel from a fuel tank 20 by means of a high pressure pump 22. An injector used for the regeneration of the particulate filter 10 is mounted in the exhaust pipe between the first oxidizing catalytic converter and the second oxidizing catalytic converter 8. The injector 24 can be fed with fuel in two ways. Either its feed circuit is connected to the low pressure portion of the HP pump 22 which is responsible for creating the high pressure in the common injection rail 18, or the feed circuit of the injector is connected to an electric pump 26 which draws the fuel directly from the tank 20 of the vehicle. Also, the injector 24 used for the regeneration of the particulate filter comprises a cooling system (not illustrated) connected to the cooling water circuit of the engine.

An ECU 30 controls the operation of the engine. Another function of the ECU 30 is to define the moment and the duration of activation (quantity injected) of the injector 24 according to the signals received showing the state of various components associated with the engine and the regeneration of the particulate filter.

The signals acquired by the control ECU 30 are, advantageously:

- the pressure 32 in the common injection rail 18;
- the temperature 34 before the turbocharger 4;
- the temperature 36 before the first oxidizing catalytic converter 6 and the temperature 38 before the second catalytic converter 8;
- the temperature 40 before the particulate filter 10;
- the temperature 42 after the particulate filter 10;
- the pressure difference between the inlet 44 of the second catalytic converter 8 and the outlet 46 of the particulate filter 10; and
- the amount and the temperature 49 of the air drawn in by the engine.

The control ECU 30 controls the operation of the air intake means 2, the exhaust gas recirculation means 3, and the turbocharger 4. It also controls the high pressure pump 22 and the injectors 16. The injection means are moreover arranged to trigger a regeneration phase of the particulate filter 10 by combustion of the particulates trapped in it by starting a phase of multiple fuel injections into the cylinders of the engine during the power stroke.

A proportional sensor 48 is disposed at the outlet of the engine 1 to regulate the recirculation of the exhaust gases according to the oxygen content of these gases at the time of the regeneration phase of the particulate filter 10.

The estimation of the rate of saturation of the particulate filter 10 is carried out through the measurement of the pressure difference between the inlet 44 of the second catalytic converter and the outlet 46 of the particulate filter. The request to activate the regeneration will be made when a preset limit threshold is reached.

Since the injector 24 is only activated during the regeneration phases, and only in certain areas of the engine speed/load map of the engine, it is seldom used during certain types of driving. Thus, the remaining fuel contained in the space inside the injector will undergo a deterioration which will depend on the temperature of the fuel inside the injector and the inactivation time of said injector. That is why the invention provides a method for anti-clogging purging of the injector 24 and anti-aging of the fuel which is based on the diagnosis of the degree of aging of the fuel. This method has the advantage of not requiring the use of additional sensors. The sensors usually used for the control of the engine and the associated components suffice. The invention consequently has the advantage of being inexpensive to apply.

The factors having a primary influence on the aging of the fuel in the injector 24 are the temperature of the injector body and the temperature of the fuel itself. The injector body temperature depends primarily on the surface temperature, the temperature of the exhaust gases and the temperature of the water in the engine cooling circuit. As for the temperature of the fuel, it is primarily dependent on the pressure in the common injection rail 18, the volume of fuel in the tank 20 and the pressure in the low pressure circuit.

Figure 2:
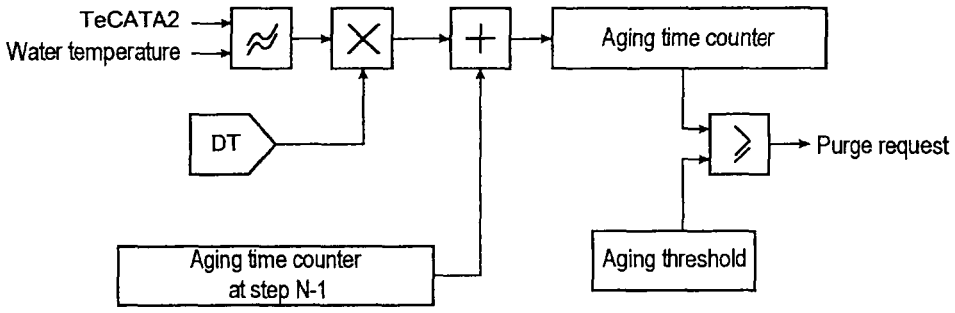
FIG. 2 is a flowchart of the estimation of the fuel aging time.

Illustrated in FIG. 2 is a flowchart of the estimation of the aging time of the fuel.

The configuration of the exhaust pipe and the installation of the injector 24 show that the signals available and those most useful for the estimation of the degree of aging of the fuel are the temperature of the water (Teau) in the engine cooling circuit and the temperature (TeCATA2) of the exhaust gases at the inlet of the second catalytic converter 8. The method of estimating the aging of the fuel therefore includes a time (DT) corrected by an aging factor mapped according to Teau and TeCaTa2:

$$\text{Aging-counter}(N)=\text{Aging-factor}(\text{Teau},\text{TeCATA2})\times DT+\text{Aging-counter}(N-1).$$

After a preset maximum aging time, the program will make a purge request:

If $$\text{Aging-counter}(N)\geqq\text{Permitted-aging-threshold},$$

then

Purge request activated.

The purge will be carried out when the correct conditions are met. The fuel aging time counter will be reset after each successful purge.

Once the aging of the fuel has been validated, it is also necessary to check that the particulate filter is not in regeneration mode and that the second oxidizing catalytic converter 8 has reached light-off, that is to say that the temperature at the inlet of this catalytic converter is at least 350° C. The main conditions authorizing the purge and therefore the actual activation of the injector are therefore:

- purge request active (aging of the fuel recognized);
- regeneration mode of the particulate filter not active;
- TeCATA2 filtered (temperature at the inlet of the particulate filter higher than a threshold temperature (T1); and
- Qair_gaz filtered (amount of air in the exhaust gases) lower than a threshold amount (Q1).

The filtering applied to TeCATA2 and Qair_gaz is a primary filtering of the widely-known exponential type.

Moreover it is necessary that the purge be suspended as soon as the start conditions are no longer met. The counting of the quantity purged will start again where it stopped when the conditions are once again met.

Figure 3:
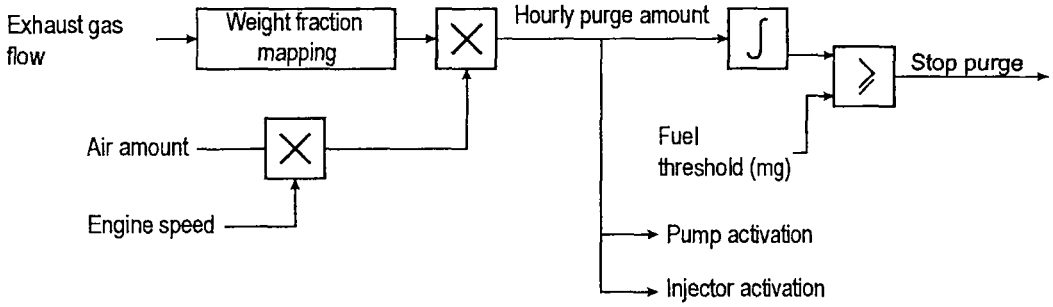
FIG. 3 illustrates a flowchart of the fuel purge management in the inventive method.

Illustrated in FIG. 3 is a flowchart of the purge amount and purge stop calculation.

As explained previously, the purge is activated when it is certain it will not have an impact on the exhaust pipe. Also, the purge amount must be controlled and limited in order not to disturb the normal course of the treatment of the gases burned in the exhaust which would tend to lead to an increase in the emissions of pollutants, the destruction of the particulate filter or the catalytic converters.

To overcome this problem, the inventive method consists in calculating the purge amount (quantity of fuel injected) according to the engine speed, the air flow through the engine and a weight fraction defined according to the amount of air in the exhaust gases:

$$\text{Purge-amount}(N)=\text{Air-amount}\times\text{Engine-speed}\times\text{Weight-fraction}(N).$$

The quantity actually purged at step N will be given by:

$$\text{Quantity-purged}(N)=\text{Purge-amount}(N)+\text{Quantity-purged}(N-1).$$

When the total quantity injected corresponds to the quantity of fuel actually remaining to be purged, the purge stop will be requested:

If $$\text{Quantity-purged}(N)\geqq\text{Quantity-of-fuel-to-be-purged}(\text{Qpurge}),$$

then "Stop purge".

For example for an air flow of approximately 50 kg/h at idle speed, the time for renewal of the diesel fuel contained inside the injector is approximately 1 minute. In less unfavorable conditions when the air flow increases, this time is reduced.

On the other hand, the regeneration will always take priority over the purge. However, the quantity of fuel (Qrégé) injected into the exhaust pipe for the requirements of the regeneration of the particulate filter will be considered as contributing to the purge:

$$\text{Purge-amount}(N)=\text{Qrégé}(N).$$

And the total quantity purged at step N will be given by:

$$\text{Quantity-purged}(N)=\text{Purge-amount}(N)+\text{Quantity-purged}(N-1)=\text{Qrégé}(N)+\text{Quantity-purged}(N-1).$$

Figure 4:
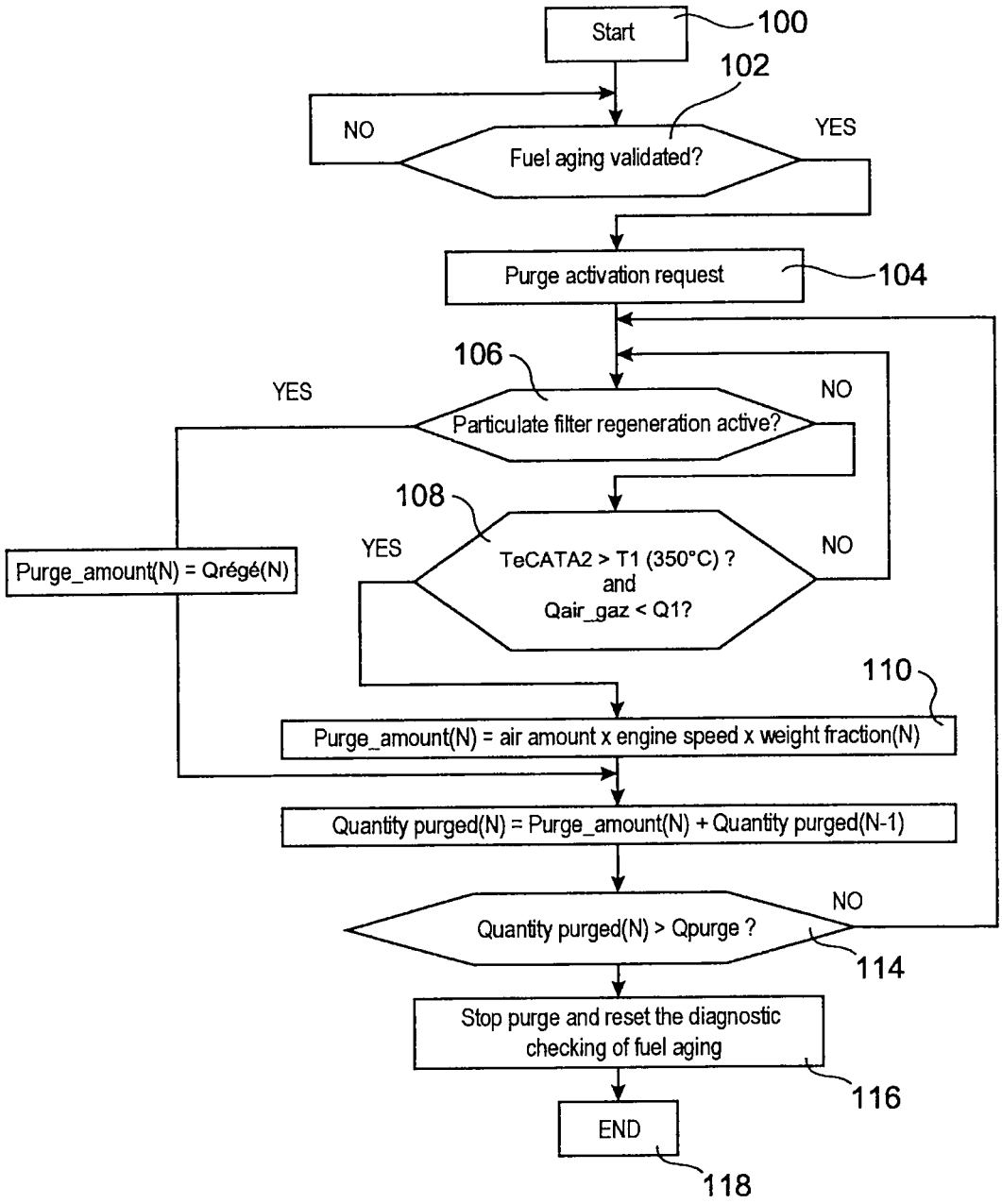
FIG. 4 is a flowchart of the purge amount and purge stop calculation.

Illustrated in FIG. 4 is a flowchart of the purge management. At step 100, the purge management procedure is started. At step 102, whether the fuel aging has been validated is checked. If it has, the purge request is activated at step 104. If not, the check is repeated in a loop until a positive response is obtained. At step 106, whether the regeneration of the particulate filter is active or not is checked. If it is active, the purge cannot be started. However, the regeneration fuel amount is taken into account in the purge amount. If not, that is to say when the regeneration of the particulate filter is not active, it is again necessary to check whether other conditions are met, for example if the second catalytic converter has reached light-off, which corresponds to the condition TeCATA2 higher than T1 (for example 350° C.) and if the amount of air contained in the exhaust gases is lower than a limit value which corresponds to the condition Qair-gaz lower than Q1 at step 108.

If these conditions are not met, the purge cannot be started and the regeneration of the activation of the particulate filter is checked again at step 106. If it is active, the conditions are met and the purge procedure can begin. The purge amount at step N to step 110 is then calculated using the formula:

$$\text{Purge-amount}(N)=\text{Air-amount}\times\text{Engine-speed}\times\text{Weight-fraction}(N).$$

At step 112, the quantity purged at step N is compared with the amount purged at step N increased by the quantity purged at step N−1. The quantity of fuel purged during the regeneration step is taken into account in the quantity purged at step N. At step 114, whether the quantity purged has reached a preset quantity to be purged is checked. If not, the activation of the regeneration of the particulate filter is checked again at step 106. If the preset quantity to be purged has been reached, the purge is stopped and the diagnostic checking of fuel aging is reset at step 116 and the procedure ends at step 118.

The invention claimed is:

1. A method for purging an injector in a fuel injection system used for regeneration of a particulate filter, comprising:

determining aging of fuel, comparing the determined age with a fuel aging threshold value, and activating a purge request if the threshold value is exceeded;

when the purge request is activated, meeting of conditions for activating the purge is checked and, if the conditions are met, the purge is activated; and continuing the purge as long as the conditions are met, until a quantity of fuel purged reaches a quantity of fuel to be purged.

2. The method as claimed in claim 1, wherein a fuel aging counter is determined by multiplying an aging factor based on aging variables by an aging time and adding the result obtained to the aging counter.

3. The method as claimed in claim 2, wherein the aging variables include temperature of water and temperature of exhaust gases at an inlet of a catalytic converter disposed upstream of the particulate filter.

4. The method as claimed in claim 1, wherein the conditions for activating the purge include, in addition the purge request being activated, whether a regeneration mode of the particulate filter is not active, whether a temperature of gases at an inlet of the particulate filter is higher than a threshold value, and whether an amount of air in the exhaust gases is lower than a threshold amount.

5. The method as claimed in claim 1, wherein, if the purge is interrupted by a regeneration of the particulate filter, the quantity of fuel used for the regeneration is considered as contributing to the purge.

* * * * *